US011365940B2

(12) United States Patent
Ojiro et al.

(10) Patent No.: US 11,365,940 B2
(45) Date of Patent: Jun. 21, 2022

(54) PLATE-TYPE HEAT EXCHANGER AND HEAT SOURCE APPARATUS

(71) Applicant: Rinnai Corporation, Nagoya (JP)

(72) Inventors: Takashi Ojiro, Kitanagoya (JP); Takahiro Ono, Nagoya (JP)

(73) Assignee: Rinnai Corporation, Nagoya (JP)

( * ) Notice: Subject to any disclaimer, the term of this patent is extended or adjusted under 35 U.S.C. 154(b) by 163 days.

(21) Appl. No.: 16/674,020

(22) Filed: Nov. 5, 2019

(65) Prior Publication Data

US 2020/0166282 A1 May 28, 2020

(30) Foreign Application Priority Data

Nov. 27, 2018 (JP) ..... JP2018-221469

(51) Int. Cl.

| | |
|---|---|
| ***F28D 1/03*** | (2006.01) |
| ***F28F 3/08*** | (2006.01) |
| ***F28D 9/00*** | (2006.01) |
| ***F28D 9/02*** | (2006.01) |

(52) U.S. Cl.

CPC ..... *F28D 9/0037* (2013.01); *F28D 1/0325* (2013.01); *F28D 9/0043* (2013.01); *F28D 9/02* (2013.01); *F28F 3/086* (2013.01)

(58) Field of Classification Search

CPC ..... F28F 3/086; F28D 1/0325; F28D 9/0037; F28D 9/0043; F28D 9/02

See application file for complete search history.

(56) References Cited

U.S. PATENT DOCUMENTS

| | | | | |
|---|---|---|---|---|
| 4,243,094 | A * | 1/1981 | Woodhull, Jr. | F28F 9/0212 165/174 |
| 5,575,329 | A * | 11/1996 | So | F28F 9/0217 165/167 |
| 5,718,285 | A * | 2/1998 | Oikawa | B21D 53/08 165/153 |
| 5,875,834 | A * | 3/1999 | Brooks | F28F 9/0212 165/153 |
| 5,906,237 | A * | 5/1999 | Aikawa | F28F 9/0212 165/153 |
| 6,062,303 | A * | 5/2000 | Ahn | F28F 9/0212 165/174 |
| 6,698,509 | B2 * | 3/2004 | Rong | F28F 9/0214 165/153 |
| 8,943,854 | B2 * | 2/2015 | Persson | F25B 39/022 62/525 |
| 2017/0184350 | A1 | 6/2017 | Choi et al. | |

* cited by examiner

*Primary Examiner* — Leonard R Leo
(74) *Attorney, Agent, or Firm* — Amin, Turocy & Watson, LLP

(57) ABSTRACT

The plate-type heat exchanger includes blocks stacked on each other, each of the blocks including a heat exchanger body configured to exchange heat between a first fluid and a second fluid. A connection passage for the first fluid is formed between blocks adjacent to each other of the plurality of blocks, the connection passage allowing the outlet of one of the blocks adjacent to each other and the inlet of the other of the blocks adjacent to each other to communicate with each other, the first fluid in the blocks adjacent to each other having different flow directions between the blocks adjacent to each other, and a second connection passage is provided between at least one pair of blocks adjacent to each other among the plurality of blocks, the second connection passage being configured to cause the first fluid to flow to a position different from the connection passage.

7 Claims, 10 Drawing Sheets

PLATE-TYPE HEAT EXCHANGER AND HEAT SOURCE APPARATUS

BACKGROUND OF THE INVENTION

Field of the Invention

The present invention relates to a plate-type heat exchanger and a heat source apparatus, the plate-type heat exchanger including a block formed of heat exchanger bodies each configured to exchange heat between a first fluid flowing inside the heat exchanger body and a second fluid flowing outside the heat exchanger body.

Description of the Related Art

A plate-type heat exchanger including the blocks staked on each other in an up and down direction into two or three layers of blocks is conventionally known (Korean Patent No. 10-1608149). In this conventional heat exchanger, blocks vertically adjacent to each other communicate with each other, and a flow passage of water flowing in the heat exchanger is made longer with two passages (2-PASS) or three passages (3-PASS) provided in accordance with the number of layers of blocks to increase a rate of heat exchange with combustion exhaust gas.

SUMMARY OF THE INVENTION

However, in the conventional heat exchanger, the longer the flow passage of water is, the more the water becomes stagnant in the blocks, and as a result, a high temperature area where the water is overheated is generated, which in turn makes local heat (a phenomenon where water becomes high in temperature compared with other areas, water is boiled, or the like) and lime deposition (deposition of impurities such as calcium contained in water) likely to occur. The occurrence of local heat or lime deposition accelerates deterioration of the heat exchanger bodies forming each block. Further, since a plurality of blocks are stacked, the water tends to remain in the blocks during draining. Such water that fails to be drained out and remains in the blocks may damage the heat exchanger bodies when the water has frozen. From the above, there is concern that the durability of the plate-type heat exchanger may deteriorate.

The present invention has been made in view of the above circumstances, and an object of the present invention is to provide a plate-type heat exchanger and a heat source apparatus that achieve higher durability.

A plate-type heat exchanger according to the present invention includes a plurality of blocks stacked on each other, each of the blocks including a heat exchanger body configured to exchange heat between a first fluid flowing inside the heat exchanger body and a second fluid flowing outside the heat exchanger body. In the plate-type heat exchanger, each of the blocks includes a plurality of through holes through which the second fluid flows, an inlet configured to cause the first fluid to flow into the block, and an outlet configured to cause the first fluid to flow out of the block, a connection passage for the first fluid is formed between blocks adjacent to each other of the plurality of blocks, the connection passage allowing the outlet of one of the blocks adjacent to each other and the inlet of the other of the blocks adjacent to each other to communicate with each other, the first fluid in the blocks adjacent to each other having different flow directions between the blocks adjacent to each other, and a second connection passage is provided between at least one pair of blocks adjacent to each other among the plurality of blocks, the second connection passage being configured to cause the first fluid to flow to a position different from the connection passage.

The above structure allows the first fluid to flow between the blocks adjacent to each other through the second connection passage. This forms a new flow of the first fluid in each block through the second connection passage. The new flow of the first fluid can make a high temperature area where the first fluid becomes stagnant and is overheated in the block less likely to occur. This makes it possible to prevent local heat or lime deposition from occurring in the blocks and suppress deterioration of the heat exchanger bodies forming the blocks. This further allows the first fluid in the blocks to be drained through the second connection passage during draining. Therefore, the second connection passage thus provided increases draining performance of the blocks and makes the first fluid less likely to remain in the blocks during draining. This prevents the heat exchanger bodies of the blocks from being damaged by expansion of the remaining first fluid when the remaining first fluid has frozen. As described above, the second connection passage thus provided makes it possible to suppress local heat or lime deposition and increase the draining performance during draining, which in turn makes it possible to increase the durability of the plate-type heat exchanger.

In the plate-type heat exchanger, the second connection passage may be provided between a block located most downstream of the first fluid and a block adjacent to the block located most downstream of the first fluid among the plurality of blocks. The first fluid increases in temperature as the first fluid flows downstream, and thus, the temperature of the first fluid in the block located most downstream becomes the highest. Therefore, the second connection passage provided between the block located most downstream and the block adjacent to the block located most downstream can cause a bypass flow of the first fluid from the second connection passage in the block located most downstream to prevent the first fluid from being stagnant and prevent local heat from occurring. This makes it possible to suppress deterioration, due to local heat, of the heat exchanger bodies of the block located most downstream of the first fluid where the first fluid has the highest temperature. This further prevents lime deposition and suppresses deterioration of the heat exchanger bodies due to lime deposition.

The second connection passage is preferably provided close to the outlet of the block located most downstream of the first fluid rather than the connection passage between the block located most downstream of the first fluid and the block adjacent to the block located most downstream of the first fluid. That is, in the block located most downstream of the first fluid, the first fluid has the highest temperature near the outlet located downstream of the first fluid. Therefore, the second connection passage provided near the outlet of the block located most downstream can cause the bypass flow of the first fluid from the second connection passage to prevent the first fluid from being stagnant and prevent local heat from occurring. This makes it possible to suppress deterioration, due to local heat, of the heat exchanger bodies of the block located most downstream of the first fluid where the first fluid has the highest temperature. This further prevents lime deposition and suppresses deterioration of the heat exchanger bodies due to lime deposition.

Further, in the plate-type heat exchanger, with the plurality of blocks stacked on each other in a vertical direction, the second connection passage can be provided close to the inlet of a lower block of blocks vertically adjacent to each other rather than the connection passage between the blocks vertically adjacent to each other. During draining, the first fluid in the upper block tends to remain at a position away from the connection passage between the upper block and the lower block. Therefore, the second connection passage provided close to the inlet of the lower block rather than the connection passage allows the first fluid located away from the connection passage to be drained, through the second connection passage in the upper block. Since the first fluid is drained without remaining in the upper block during draining, it is possible to prevent the heat exchanger bodies from being damaged due to expansion of the remaining first fluid when the remaining first fluid has frozen and increase the durability of the plate-type heat exchanger.

The second connection passage is preferably provided at a position that does not overlap a plane where the inlet of the lower block is projected. That is, when the second connection passage is provided on the plane where the inlet is projected, a part of the first fluid flowing in through the inlet tends to take a shortcut through the second connection passage during normal use. Therefore, the second connection passage provided at the position shifted from the plane where the inlet is projected makes it possible to minimize a flow rate of the first fluid taking a shortcut through the second connection passage. This makes it possible to prevent the heat exchange performance from being degraded due to the first fluid taking a shortcut through the second connection passage.

In the plate-type heat exchanger, the second connection passage is preferably smaller in opening area than the connection passage. This allows most of the first fluid to flow in the block without taking a shortcut through the second connection passage during normal use and thus makes it possible to prevent the heat exchange performance from being degraded.

Further, the plate-type heat exchanger according to the present invention may have a structure including a plurality of heat exchanger bodies stacked on each other, each of the heat exchanger bodies configured to exchange heat between a first fluid flowing inside the heat exchanger bodies and a second fluid flowing outside the heat exchanger bodies. In the plate-type heat exchanger, each of the heat exchanger bodies includes a communication passage configured to cause the first fluid to flow into or flow out of the heat exchanger body, and a bypass hole is provided at a position where the first fluid is stagnant between all or some heat exchanger bodies adjacent to each other of the plurality of heat exchanger bodies stacked on each other, the bypass hole being configured to cause the first fluid to flow from an adjacent heat exchanger body. This structure makes it possible to cause the bypass flow of the first fluid from the bypass hole to prevent the first fluid in the heat exchanger body from being stagnant, prevent local heat from occurring, and prevent lime deposition from occurring.

Further, the present invention is applicable to a heat source apparatus including at least one of the plate-type heat exchangers, and the heat source apparatus exhibits the same effect as that of the plate-type heat exchangers exhibit.

DETAILED DESCRIPTION OF THE PREFERRED EMBODIMENT

Figure 1:
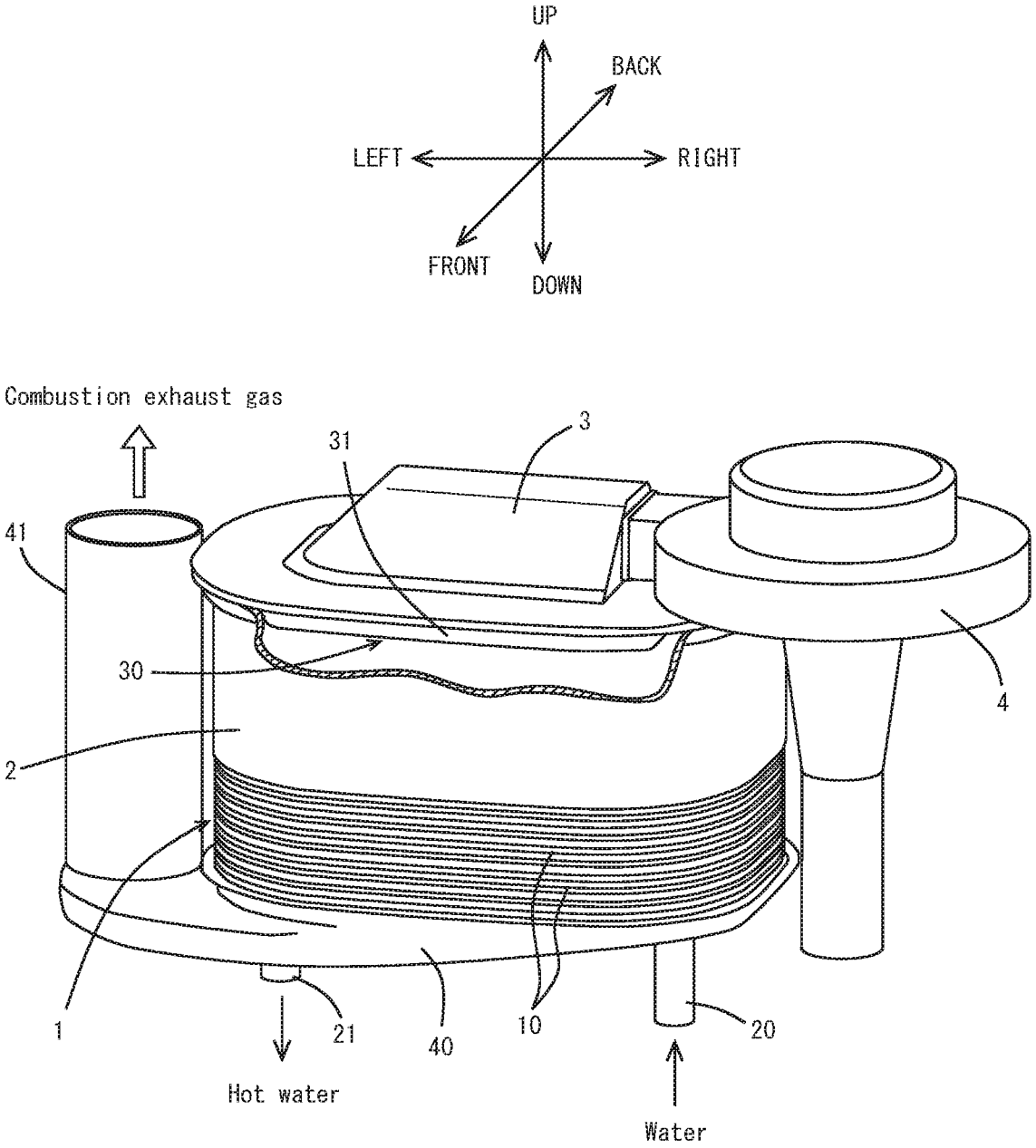
FIG. 1 is a partially cutaway perspective view showing a heat source apparatus according to a preferred embodiment.

A description will be given below of a preferred embodiment of the present invention with reference to the attached drawings.

The present preferred embodiment is a heat source apparatus including a plate-type heat exchanger, and examples of the heat source apparatus include a water heater and a boiler. In the heat source apparatus shown in FIG. 1, a burner body 3 forming a burner 31, a combustion chamber 2, a heat exchanger 1, and a drain receiver 40 are arranged in that order from top to bottom. A fan case 4 including a combustion fan (not shown) that feeds mixed gas containing fuel gas and air into the burner body 3 is disposed on one side of the burner body 3. An exhaust duct 41 communicating with the drain receiver 40 is disposed on the other side of the burner body 3.

Note that, herein, when the heat source apparatus is viewed from the front with the fan case 4 and the exhaust duct 41 positioned on the sides of the burner body 3, a depth direction corresponds to a front and back direction, a width direction corresponds to a left and right direction, and a height direction corresponds to an up and down direction (see FIG. 1).

In this heat source apparatus, combustion exhaust gas (second fluid) sent downward from a downward combustion surface 30 of the burner 31 is fed into the heat exchanger 1 through the combustion chamber 2 to flow in the heat exchanger 1. Then, the combustion exhaust gas flowing out from the heat exchanger 1 is discharged out of the heat source apparatus through the drain receiver 40 and the exhaust duct 41. An inflow pipe 20 and an outflow pipe 21 are connected to the heat exchanger 1, water (first fluid) flowing into the heat exchanger 1 through the inflow pipe 20 is heated by the combustion exhaust gas while flowing in the heat exchanger 1, and the heated water (hot water) is discharged out of the heat exchanger 1 through the outflow pipe 21. Note that the first fluid to be caused to flow in the heat exchanger 1 is not limited to water, and another fluid (for example, antifreeze) may be used.

Figure 2:
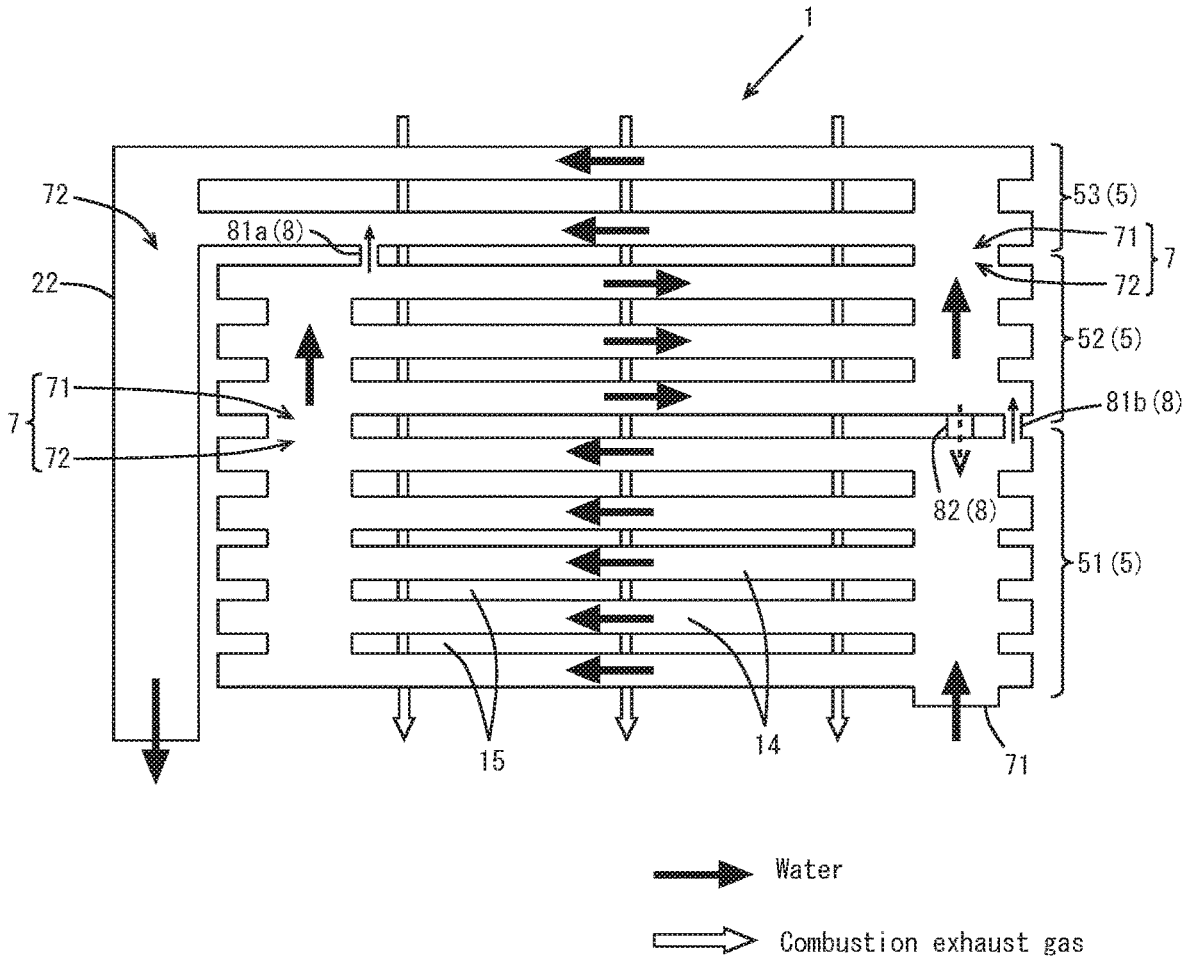
FIG. 2 is a schematic diagram for describing a structure of a heat exchanger in the heat source apparatus according to the preferred embodiment, the heat exchanger including a plurality of layers of blocks.
Figure 3:
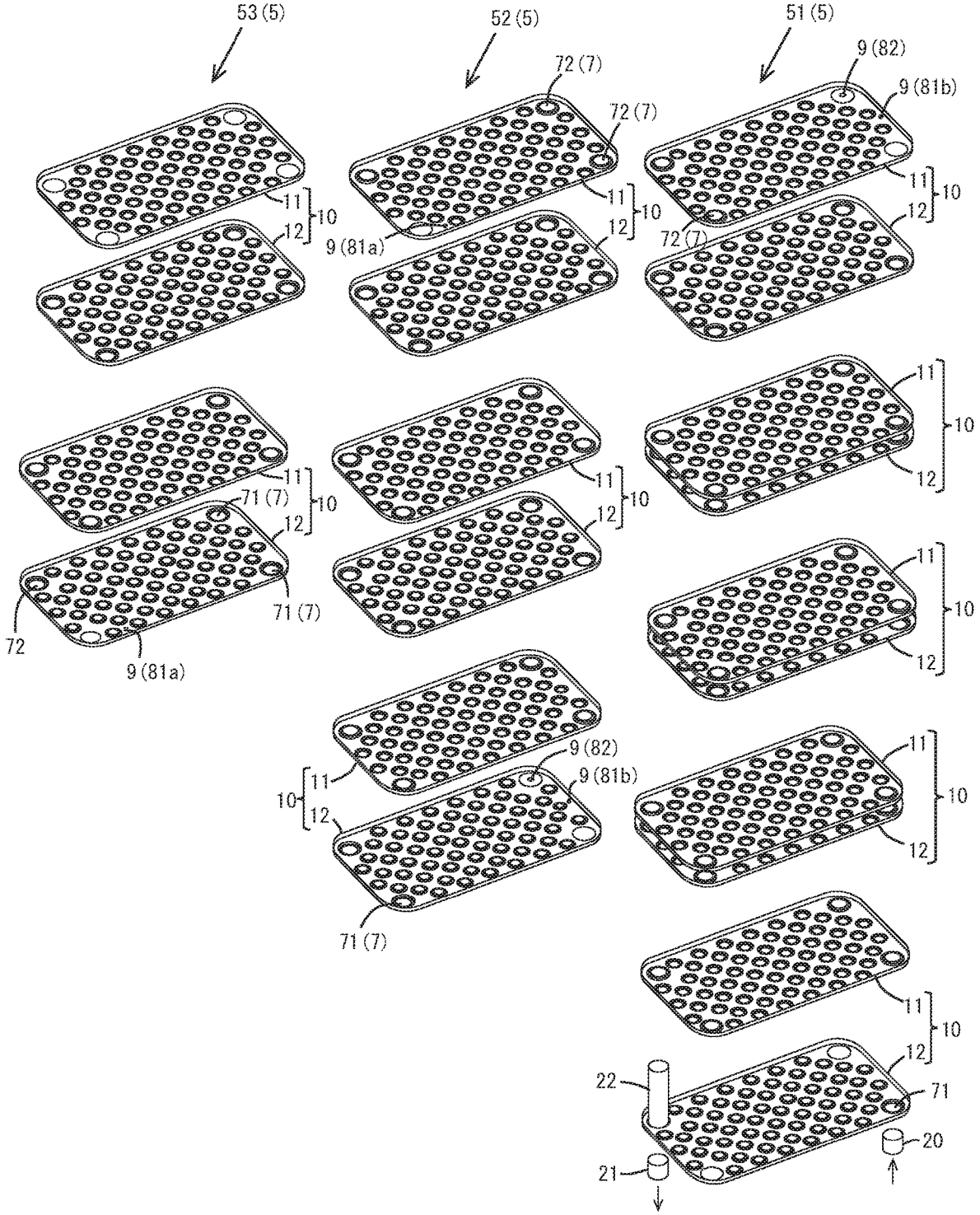
FIG. 3 is an exploded perspective view showing heat exchanger bodies forming each block.

As shown in FIG. 2 and FIG. 3, the heat exchanger 1 is a plate-type heat exchanger 1 and includes a block 5 formed of a heat exchanger body 10 that has a thin plate shape and exchange heat between the water (first fluid) flowing inside the heat exchanger body 10 and the combustion exhaust gas (second fluid) flowing outside the heat exchanger body 10.

The block 5 is formed of a plurality of the heat exchange bodies 10 stacked on each other, but may be formed of one heat exchanger body 10. In the block 5, formed is a flow passage through which the water flows toward one side in an extending direction of the heat exchanger body 10. The heat exchanger 1 is formed of three layers of blocks 5 (51, 52, 53) stacked on each other in the up and down direction. Accordingly, in the heat exchanger 1, a water flow passage includes three passages (3-PASS) in accordance with the number of layers (three layers) of the blocks 5, making the water flow passage longer. In the three layers of blocks 5, a lower-layer block 51 is formed of five heat exchanger bodies 10 stacked on each other, a middle-layer block 52 is formed of three heat exchanger bodies 10 stacked on each other, and an upper-layer block 53 is formed of two heat exchanger bodies 10 stacked on each other.

Figure 4:
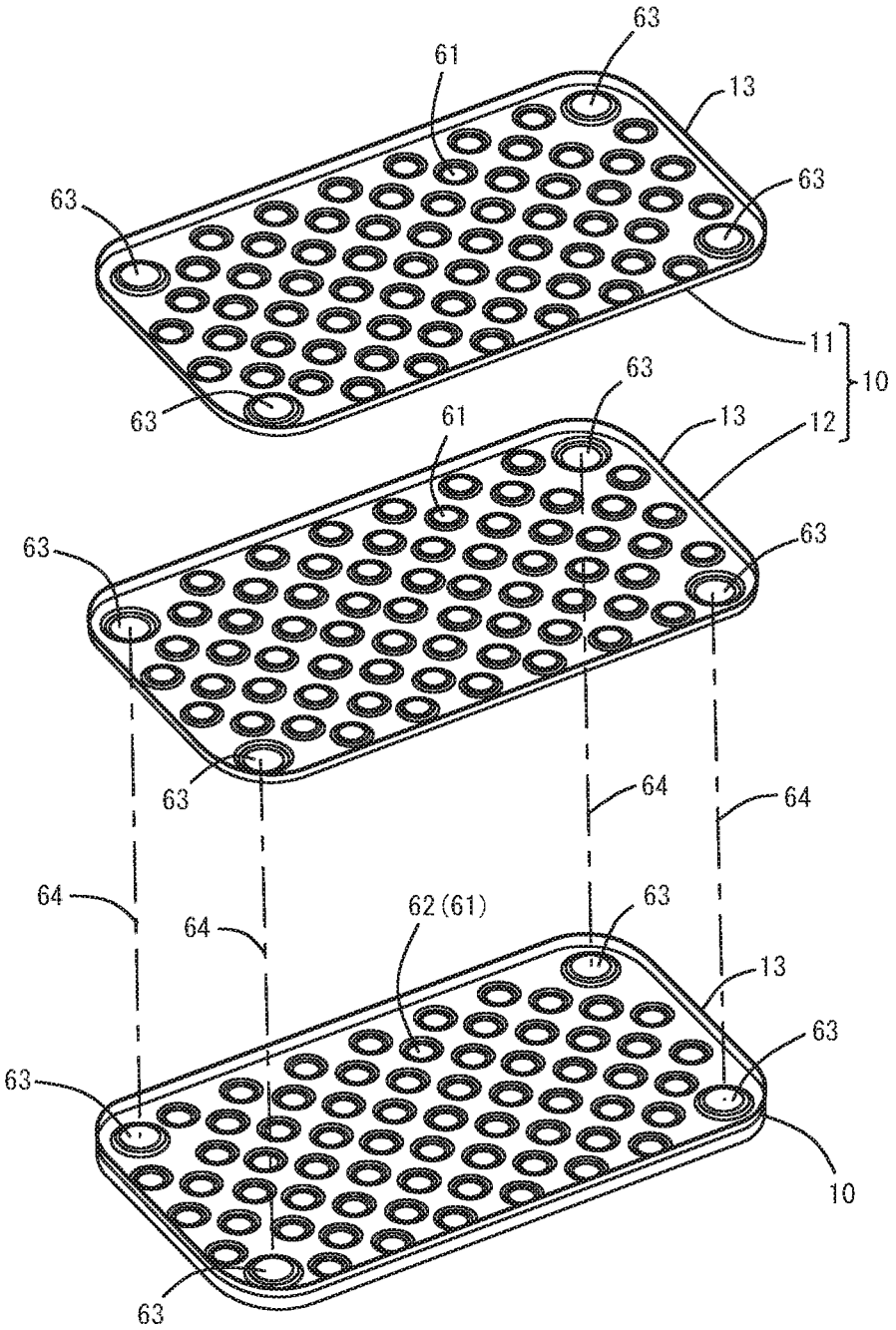
FIG. 4 is an exploded perspective view showing some of the heat exchanger bodies.
Figure 5:
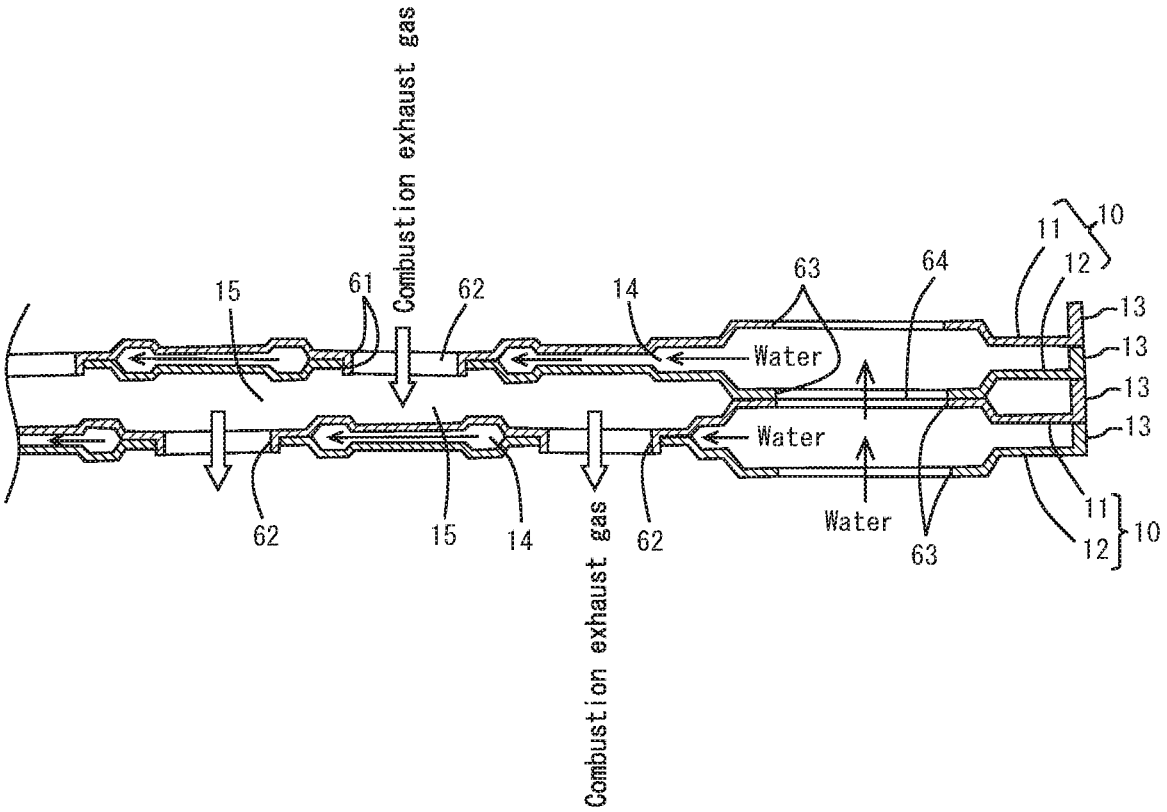
FIG. 5 is a cross-sectional view showing a structure of the heat exchanger bodies forming an exhaust hole, a communication passage, an internal space, and an external space in the heat exchanger.

As shown in FIG. 4 and FIG. 5, each of the heat exchanger bodies 10 is formed of an upper heat exchanger plate 11 and a lower heat exchanger plate 12 stacked on each other. The upper and lower heat exchanger plates 11, 12 are each made of, for example, a stainless plate and have a substantially rectangular shape in plan view with rounded four corners. On an outer periphery of each of the upper and lower heat exchanger plates 11, 12, a peripheral joint 13 having a tubular shape projecting upward is formed.

Each of the heat exchanger bodies 10 is formed of the upper heat exchanger plate 11 and the lower heat exchanger plate 12 that are stacked on each other in the up and down direction and joined to each other through joining of the peripheral joint 13 of the lower heat exchanger plate 12 and a bottom outer periphery of the upper heat exchanger plate 11 with a brazing filler metal or the like. Accordingly, an internal space 14 having a predetermined height is formed between the upper and lower heat exchanger plates 11, 12, and the water is caused to flow through the internal space 14.

The heat exchanger 1 is formed of a plurality of the heat exchanger bodies 10 that are stacked on each other in the up and down direction and joined to each other through joining of the peripheral joint 13 of the upper heat exchanger plate 11 of a lower heat exchanger body 10 and the bottom outer periphery of the lower heat exchanger plate 12 of an upper heat exchanger body 10 with a brazing filler metal or the like. Accordingly, an external space 15 having a predetermined height is formed between heat exchanger bodies 10 vertically adjacent to each other, and the combustion exhaust gas is caused to flow through the external space 15.

Further, the upper and lower heat exchanger plates 11, 12 have an exhaust opening 61 that has a substantially circular shape and allows the combustion exhaust gas to pass therethrough formed across their respective plate surfaces excluding corners, and have a water passage hole 63 that has a substantially circular shape and causes the water to flow into and out from the internal space 14 formed at all or some of their respective four corners.

Inner peripheries of the upper and lower exhaust openings 61 of the upper and lower heat exchanger plates 11, 12 are protruded inward, and are swaged and joined to each other with a brazing filler metal or the like, thereby forming an exhaust hole 62 that is a through hole extending through the internal space 14 without communicating with the internal space 14 and communicating with the external space 15. A number of the exhaust holes 62 are formed in a grid pattern at predetermined intervals in the front and back direction and left and right direction all across the upper and lower heat exchanger plates 11, 12. The exhaust holes 62 between heat exchanger bodies 10 adjacent to each other have a positional relation in which the exhaust holes 62 are arranged to be shifted from each other by half a pitch in the left and right direction. This arrangement causes the combustion exhaust gas flowing from an upper side to pass through the exhaust holes 62 of one of the heat exchanger bodies 10 and then flow and diffuse into the external space 15 located between the heat exchanger body 10 and a lower adjacent heat exchanger body 10. Accordingly, the combustion exhaust gas flowing from the upper side to the lower side in the block 5 flows along a zigzag path in the block 5, thereby bringing the combustion exhaust gas into contact with each of the heat exchanger bodies 10 for a longer time and in turn increasing a rate of heat exchange with the water.

Inner peripheries of the upper and lower water passage holes 63 of the upper and lower heat exchanger plates 11, 12 are protruded outward, and are each joined to a corresponding inner periphery of the water passage hole 63 of an adjacent heat exchanger body 10 with a brazing filler metal or the like, thereby forming a communication passage 64 extending through the external space 15 between heat exchanger bodies 10 adjacent to each other without communicating with the external space 15 and communicating with the internal space 14.

Note that, on each plate surface of the upper and lower heat exchanger plates 11, 12, a recess or a protrusion may be formed between the exhaust holes 62 substantially all across the surface. This structure causes the water and the combustion exhaust gas flowing, in the extending direction of the internal space 14 and the external space 15 on the heat exchanger body 10, through the internal space 14 and the external space 15 to flow and diffuse in a zigzag path and thus makes it possible to improve the thermal efficiency.

As shown in FIG. 2 and FIG. 3, the blocks 51, 52, 53 each have an inlet 71 that causes water to flow into the block 51, 52, 53 and an outlet 72 that causes the water to flow out of the block 51, 52, 53. The inlet 71 and the outlet 72 are formed of predetermined water passage holes 63 located on the uppermost surface or the lowermost surface of each of the blocks 51, 52, 53.

In the lower heat exchanger plate 12 serving as the lowermost surface of the lower-layer block 51, the water passage holes 63 are formed at two corners on a diagonal line, and the water passage hole 63 located at the front on the right side serves as the inlet 71. An outlet pipe 22 (see FIG. 3) extending upward to the upper-layer block 53 is inserted and joined to the water passage hole 63 located at the rear on the left side. In the upper heat exchanger plate 11 serving as the uppermost surface of the lower-layer block 51, the water passage holes 63 are formed at two corners on a left short side that are laterally separated from the inlet 71 on the right side, and the water passage hole 63 located at the front on the left short side serves as the outlet 72 of the lower-layer block 51. The outlet pipe 22 is inserted and joined to the water passage hole 63 at the rear on the left short side.

In the lower heat exchanger plate 12 serving as the lowermost surface of the middle-layer block 52, the water passage holes 63 are formed at two corners on the left short side so as to face the two water passage holes 63 in the uppermost surface of the lower-layer block 51, and the water passage hole 63 that is located at the front on the left short side and faces the outlet 72 of the lower-layer block 51 serves as the inlet 71. The outlet pipe 22 is inserted and joined to the water passage hole 63 at the rear on the left short side. In the upper heat exchanger plate 11 serving as the uppermost surface of the middle-layer block 52, the water passage holes 63 are formed at three corner other than a corner located at the front on the left short side corresponding to the inlet 71 of the middle-layer block 52, and two water passage holes 63 located at the corners on the right short side each serve as the outlet 72. The outlet pipe 22 is inserted and joined to the remaining one water passage hole 63 located at the rear on the left short side. Between the lower-layer and middle-layer blocks 51, 52 adjacent to each other, the outlet 72 of the lower-layer block 51 and the inlet 71 of the middle-layer block 52 are joined to each other to form a water connection passage 7.

In the lower heat exchanger plate 12 serving as the lowermost surface of the upper-layer block 53, the water passage holes 63 are formed at three corners (three corners other than a corner located at the front on the left short side) to face the three water passage holes 63 located in the uppermost surface of the middle-layer block 52. Of the three water passage holes 63, two water passage holes 63 on the right short side facing the two outlets 72 of the middle-layer block 52 each serve as the inlet 71, and the remaining one water passage hole 63 at the rear on the left short side serves as the outlet 72. An upper end of the outlet pipe 22 is joined to each of the water passage holes 63 serving as the outlet 72. Note that no water passage hole 63 is formed in the upper heat exchanger plate 11 serving as the uppermost surface of the upper-layer block 53. Between the middle-layer and upper-layer blocks 52, 53 adjacent to each other, the two outlets 72 of the middle-layer block 52 and the two inlets 71 of the upper-layer block 53 are joined to each other to form the water connection passages 7. That is, two connection passages 7 are formed on the right short side between the middle-layer and upper-layer blocks 52, 53 adjacent to each other.

In the upper and lower heat exchanger plates 11, 12 other than the upper heat exchanger plate 11 serving as the uppermost surface and the lower heat exchanger plate 12 serving as the lowermost surface of each of the blocks 51, 52, 53, the water passage holes 63 are formed at four corners. Of these water passage holes 63, upper and lower water passage holes 63 coaxially aligned are joined to each other to form the communication passages 64 (see FIG. 4 and FIG. 5). Further, the outlet pipe 22 directly communicates with the internal space 14 of the heat exchanger body 10 located on a lower side of the upper-layer block 53.

With the above structure, with reference to FIG. 2 and FIG. 3, the water flowing through the inflow pipe 20 into the inlet 71 on the lower surface of the lower-layer block 51 flows upward through two communication passages 64 located on the right side of the lower-layer block 51, enters the internal space 14 of each heat exchanger body 10, and then flows toward one side (right to left indicated by black arrows in FIG. 2) in the left and right direction of each internal space 14. The water flowing through each internal space 14 flows upward through one communication passage 64 located on the left side, and flows out from the outlet 72 on the upper surface of the lower-layer block 51.

The water flowing out from the lower-layer block 51 flows into the inlet 71 on the lower surface of the middle-layer block 52 through the connection passage 7. The water flowing in through the inlet 71 of the middle-layer block 52 flows upward through one communication passage 64 coaxially aligned with the inlet 71 and located on the left side of the middle-layer block 52, enters the internal space 14 of each heat exchanger body 10, and flows toward one side (left to right indicated by black arrows in FIG. 2) in the left and right direction of each internal space 14. A flow direction of the water flowing through each internal space 14 of the middle-layer block 52 is opposite to a flow direction of the water flowing through each internal space 14 of the lower-layer block 51. The water flowing through each internal space 14 flows upward through two communication passages 64 located on the right side and flows out from the outlets 72 on the upper surface of the middle-layer block 52.

The water flowing out from the middle-layer block 52 flows into the inlets 71 on the lower surface of the upper-layer block 53 through the two connection passages 7. The water flowing in through the two inlets 71 on the lower surface of the upper-layer block 53 flows upward through two communication passages 64 aligned coaxially with the two inlets 71 and located on the right side of the upper-layer block 53, enters the internal space 14 of each heat exchange body 10, and flows toward one side (right to left indicated by black arrows in FIG. 2) in the left and right direction of each internal space 14. A flow direction of the water flowing through each internal space 14 of the upper-layer block 53 is opposite to a flow direction of the water flowing through each internal space 14 of the middle-layer block 52. In the upper-layer block 53, the water flowing through the internal space 14 of the heat exchanger body 10 located on the lower side flows out from the outlet 72 located at the rear on the left side, and the water flowing through the internal space 14 of the heat exchanger body 10 located on the upper side flows downward through two communication passages 64 located on the left side of the lower surface and then flows out from the outlet 72. The water led out from the outlet 72 of the upper-layer block 53 flows into the outlet pipe 22, flows downward through the outlet pipe 22, and flows out of the heat exchanger 1 from the outflow pipe 21 connected to the lower-layer block 51.

As described above, the water flowing in the heat exchanger 1 flows through the three passages (3-PASS) made by the three layers of blocks 51, 52, 53, making the flow passage longer. The water flowing through each of the blocks 51, 52, 53 is heated by the combustion exhaust flowing in the heat exchanger 1. Accordingly, the heat exchanger 1 causes the water to flow through such a long flow passage formed of the three passages to increase a rate of heat exchange with the combustion exhaust.

Further, in the heat exchanger 1 according to the present preferred embodiment, a second connection passage 8 (see FIG. 2) that causes water to flow into a position different from the connection passage 7 is formed between blocks 5 adjacent to each other. The second connection passage 8 is formed of small holes 9 (see FIG. 3) that are formed through the upper heat exchanger plate 11 serving as the upper surface of a lower block 5 of blocks 5 vertically adjacent to each other and the lower heat exchanger plate 12 serving as the lower surface of an upper block 5 and are connected to each other. That is, the second connection passage 8 is formed of the upper and lower small holes 9 that are coaxially aligned with each other and have their respective inner peripheries protruded outward from the heat exchanger bodies 10 and joined to each other with a brazing material or the like. The second connection passage 8 serves as a bypass hole 81 or a drain hole 82.

The bypass hole 81 that is one form of the second connection passage 8 allows the internal spaces 14 of two heat exchanger bodies 10 facing each other to communicate with each other between blocks 5 adjacent to each other and causes the water to flow from the upper heat exchanger body 10 into the lower heat exchanger body 10 between the blocks 5 adjacent to each other during normal use, separately from the connection passage 7. This allows the water to flow between the blocks 5 adjacent to each other through the bypass hole 81 in addition to the connection passage 7. In each block 5, a bypass flow that is a new flow of the water through the bypass hole 81 is formed. This bypass flow can make a high temperature area where the water becomes stagnant and is overheated in the block 5 less likely to occur. This makes it possible to prevent local heat or lime deposition from occurring in the block 5 and suppress deterioration of the heat exchanger bodies 10 forming the blocks 5. This in turn makes it possible to increase durability of the heat exchanger 1.

For example, as shown in FIG. 2, FIG. 3, and FIGS. 6A and 6B, the bypass holes 81 are provided as a first bypass hole 81*a* between the upper-layer and middle-layer blocks 52, 53 adjacent to each other and a second bypass hole 81*b* between the middle-layer and lower-layer blocks 51, 52 adjacent to each other. In particular, it is advantageous that the first bypass hole 81*a* is provided between the upper-layer and middle-layer blocks 52, 53 adjacent to each other. That is, the water flowing in the heat exchanger 1 increases in temperature as the water flows downstream, and thus, the temperature of the water in the upper-layer block 53 located most downstream becomes the highest. Accordingly, local heat or lime deposition is likely to occur in the upper-layer block 53 located most downstream of the water due to the stagnation of the water. Therefore, the first bypass hole 81*a* provided between the upper-layer block 53 located most downstream and the middle-layer block 52 adjacent to the upper-layer block 53 can cause the bypass flow of the water from the first bypass hole 81*a* in the upper-layer block 53 to prevent the water from being stagnant and prevent local heat from occurring. This makes it possible to suppress deterioration of the heat exchanger bodies 10 of the upper-layer block 53 due to local heat. This further prevents lime deposition and thus suppresses deterioration of the heat exchanger bodies 10 due to lime deposition.

The first bypass hole 81*a* is formed of small holes 9 that are provided through the lower heat exchanger plate 12 of the heat exchanger body 10 located lowermost of the upper-layer block 53 and the upper heat exchanger plate 11 of the heat exchanger body 10 located uppermost of the middle-layer block 52 and are joined to communicate with each other. This first bypass hole 81*a* may be provided at any position in the heat exchanger body 10, but is preferably provided at any position close to the outlet 72 of the upper-layer block 53 located most downstream rather than the connection passage 7 between the upper-layer and middle-layer blocks 52, 53. That is, in the upper-layer block 53, the water has the highest temperature near the outlet 72 located downstream of the water. Therefore, the first bypass hole 81*a* provided near the outlet 72 of the upper-layer block 53 can cause the bypass flow of the water from the first bypass hole 81*a* to prevent the water near the outlet 72 from being stagnant and prevent local heat or lime deposition from occurring.

Figure 6A:
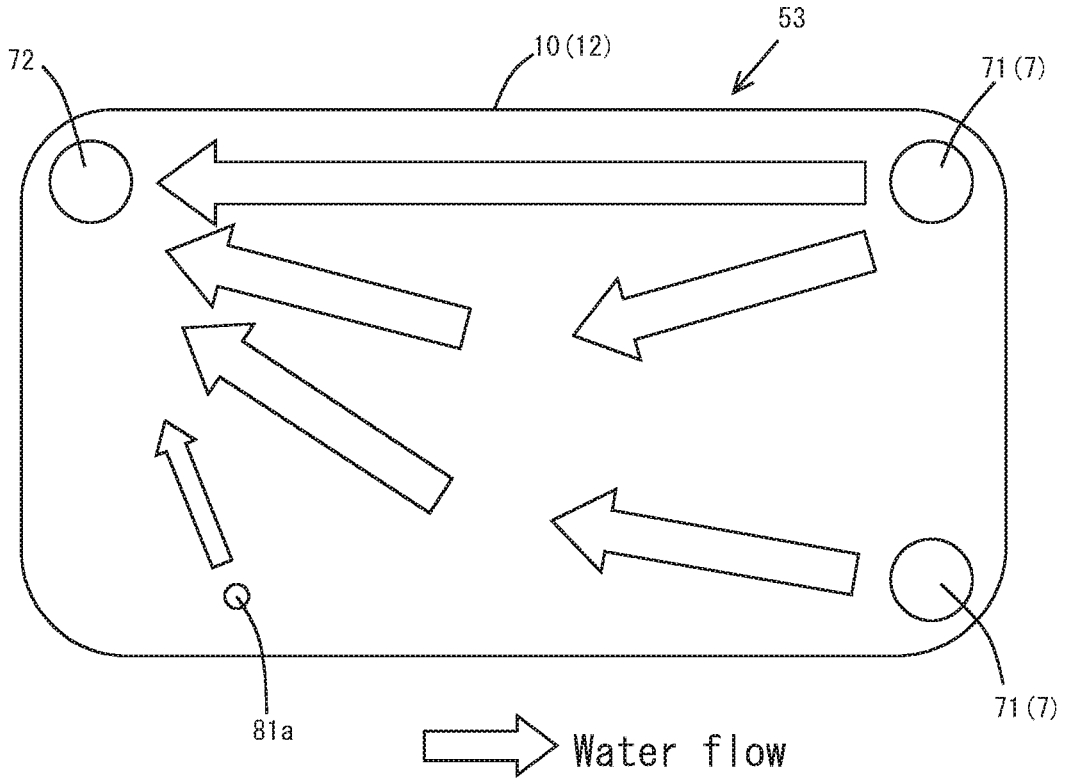
FIGS. 6A and 6B are schematic diagrams for describing positions of bypass holes each serving as a second connection passage.
Figure 6B:
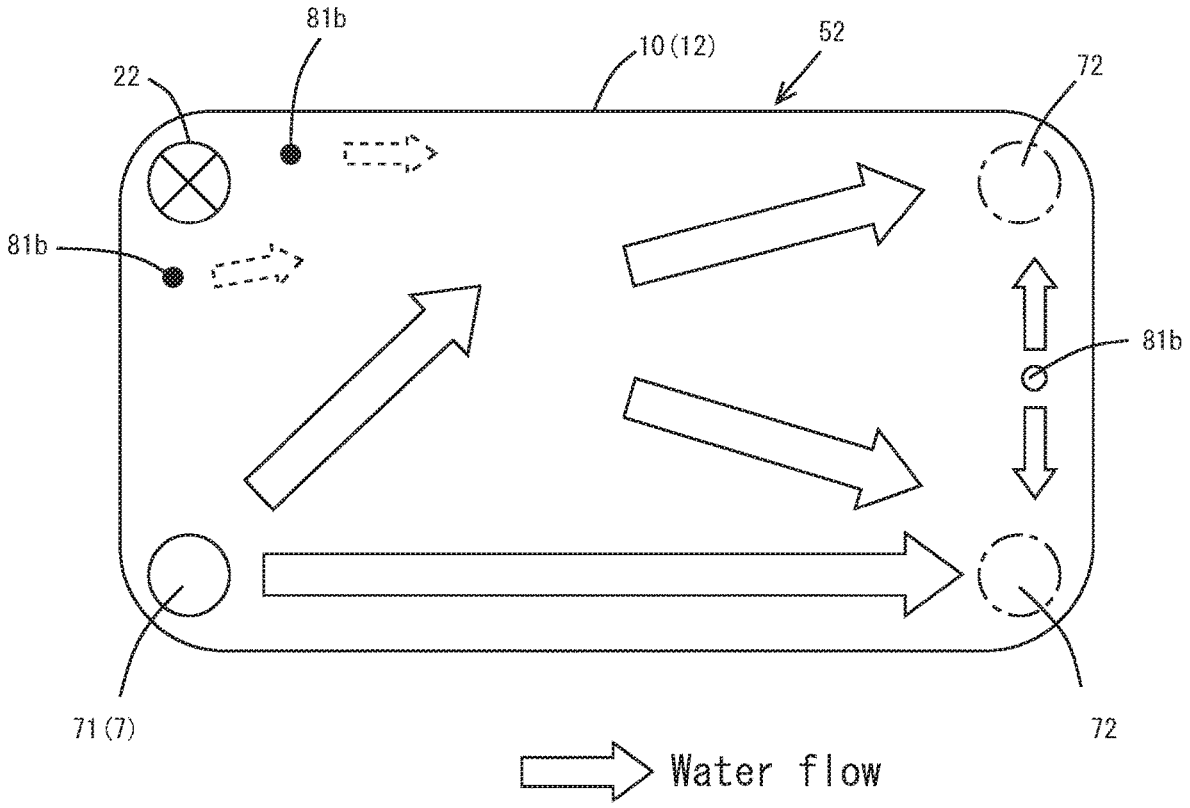

Specifically, the first bypass hole 81*a* is provided at a position that is near a closed corner located at the front on the left side of the lower heat exchanger plate 12 serving as the lowermost surface of the upper-layer block 53 and is closer to the long side of this corner (see FIG. 6A). That is, with reference to FIG. 6A, the flow of the water near the closed corner may be slow due to a longer flow passage extending from the inlet 71 located at the front of the two inlets 71 located on the right side to the outlet 72 located at the rear on the left side. Further, in an area on the short side of the closed corner located at the front on the left side, stagnation is less likely to occur due to the fact that the water flows through the water passage hole 63 of the upper heat exchanger plate 11 located above the area from the upper heat exchanger body 10, but an area on the long side of the closed corner is out of the area where the water from the upper heat exchanger body 10 flows. Accordingly, the water tends to be stagnant in the area on the long side near the closed corner. Therefore, the first bypass hole 81*a* provided at this position to generate the bypass flow (a narrow white arrow in FIG. 6A) makes it possible to prevent the water in the internal space 14 from being stagnant.

The second bypass hole 81*b* is formed of small holes 9 that are provided through the lower heat exchanger plate 12 of the heat exchanger body 10 located lowermost of the middle-layer block 52 and the upper heat exchanger plate 11 of the heat exchanger body 10 located uppermost of the lower-layer block 51 and are joined to communicate with each other. This second bypass hole 81*b* may be provided at any position in the heat exchanger body 10, but is preferably provided at any position close to the outlets 72 of the middle-layer block 52 located downstream rather than the connection passage 7 between the middle-layer and lower-layer blocks 51, 52. Specifically, the second bypass hole 81*b* is provided at a position (see FIG. 6B) corresponding to a position near a middle point of a straight line connecting the two outlets 72 of the middle-layer block 52. That is, with reference to FIG. 6B, a main flow of water flowing through the internal space 14 located lowermost of the middle-layer block 52 is directed toward positions corresponding to the two outlets 72 on the right side, and thus, near the middle point, the water tends to flow slowly and be stagnant. Therefore, the second bypass hole 81*b* provided near this middle point to generate a bypass flow (narrow white arrows in FIG. 6B) makes it possible to prevent the water in the internal space 14 from being stagnant.

Further, the second bypass hole 81*b* may be provided at any position (for example, positions indicated by black circles in FIG. 6B) near a corner located at the rear on the left side, the corner being closed by the outlet pipe 22. That is, the flow of the water near the corner closed by the outlet pipe 22 in the internal space 14 located lowermost of the middle-layer block 52 may be slow due to a longer flow passage extending from the inlet 71 located at the front on the left side to the outlet 72 located at the rear on the right side, and thus, near the corner closed by the outlet pipe 22, the water tends to be stagnant. Therefore, the second bypass hole 81*b* provided at a position near the corner closed by the outlet pipe 22 to generate a bypass flow (narrow arrows indicated by dotted lines in FIG. 6B) makes it possible to prevent the water in the internal space 14 from being stagnant.

Note that the bypass hole 81 described above is provided not only between the blocks 5 adjacent to each other but also between all or some heat exchanger bodies 10 adjacent to each other of the plurality of heat exchanger bodies 10 stacked in each block 5. Further, regardless of whether the bypass hole 81 is provided between the blocks 5 adjacent to each other, the bypass hole 81 may be provided between all or some heat exchanger bodies 10 adjacent to each other of the plurality of heat exchanger bodies 10 stacked in the whole of the heat exchanger 1. Furthermore, the position where the bypass hole 81 is provided is an area where the water in the internal space 14 of the heat exchanger body 10 becomes stagnant. For example, looking at one heat exchanger body 10, in an area out of a straight line connecting a water inlet (specific communication passage 64) and a water outlet (specific other communication passage 64) on a plane, the water may be stagnant, and thus any number of bypass holes 81 can be provided at any positions in the area.

Next, the drain hole 82 that is the other form of the second connection passage 8 allows the internal spaces 14 of two heat exchanger bodies 10 facing each other to communicate with each other between blocks 5 vertically adjacent to each other and drains the water from the upper block 5 into the lower block 5 between the blocks 5 adjacent to each other during draining, separately from the connection passage 7. This allows, during draining, the water in the upper block 5 to be drained through the drain hole 82. Therefore, the drain hole 82 thus provided increases draining performance of the block 5 and makes the water less likely to remain in the block 5 during draining. This prevents the heat exchanger body 10 of the block 5 from being damaged by expansion of the remaining water when the remaining water has frozen. This in turn makes it possible to increase durability of the heat exchanger 1.

Figure 7:
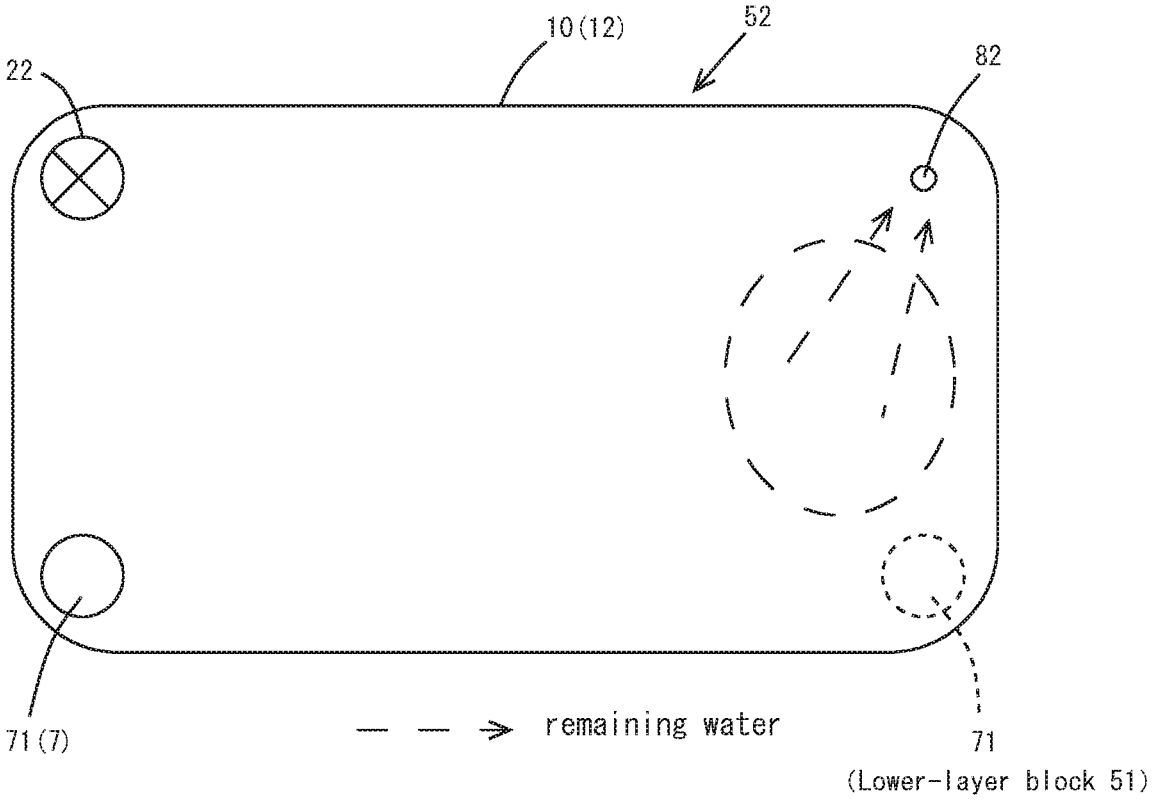
FIG. 7 is a schematic diagram for describing a position of a drain hole serving as the second connection passage.
Figure 8A:
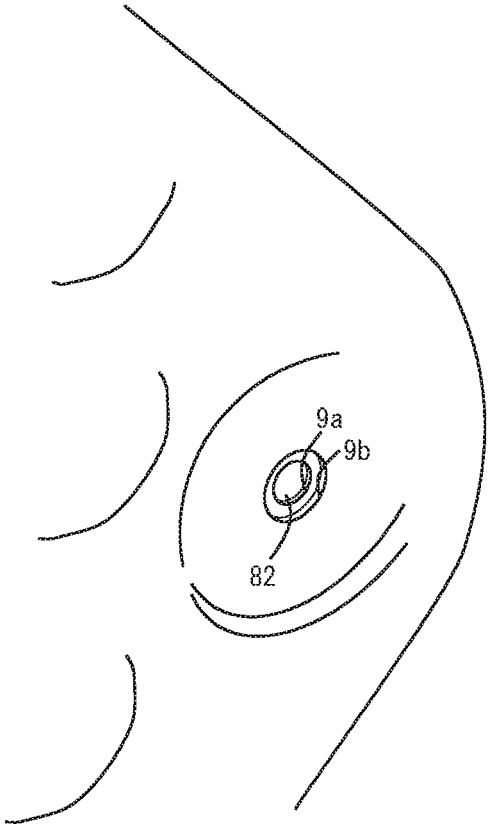
FIG. 8A is a perspective view showing a structure of the drain hole formed of two small holes having different diameters.
Figure 8B:
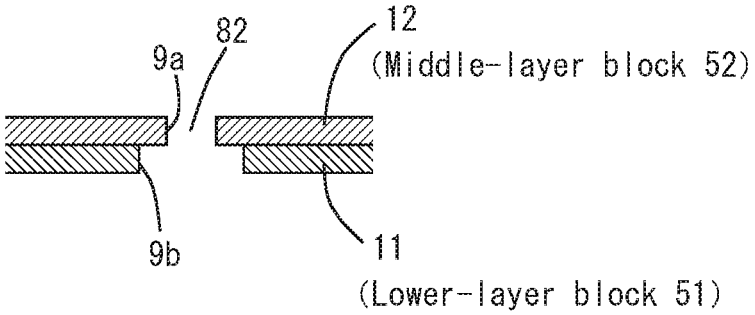
FIG. 8B is a cross-sectional view showing the structure.

As shown in FIG. 2, FIG. 3, and FIG. 7, the drain hole 82 is formed of small holes 9 that are provided through the lower heat exchanger plate 12 of the heat exchanger body 10 located lowermost of the upper-layer block 52 and the upper heat exchanger plate 11 of the heat exchanger body 10 located uppermost of the lower-layer block 51 and are joined to communicate with each other. For example, the drain hole 82 is formed of the upper and lower small holes 9 that are formed coaxially with each other and have their respective inner peripheries protruded outward from the heat exchanger bodies 10 and joined to each other with a brazing material or the like. In this structure, the upper and lower small holes 9 may have the same diameter, but, as shown in FIGS. 8A and 8B, it is preferable that a lower small hole 9*b* be sufficiently larger in diameter than an upper small hole 9*a* such that a diameter of the drain hole 82 is limited by the diameter of the upper small hole 9*a* where the water is accumulated. This prevents an opening area of the drain hole 82 from being reduced due to displacement between the upper and lower small holes 9*a*, 9*b* caused by displacement between the plates 11, 12 joined to each other with a brazing material or the like. This further prevents the drain hole 82 from being closed by a water film formed of water accumulated in a step around the upper small hole 9*a* when the upper small hole 9*a* where the water is accumulated is smaller in diameter than the lower small hole 9*b*. In this structure, the upper small hole 9*a* and the lower small hole 9*b* may have a diameter of 4 mm and a diameter of 6 mm, respectively, for example.

Specifically, the drain hole 82 is provided, between the middle-layer and lower-layer blocks 51, 52 adjacent to each other, at any position close to the inlet 71 of the lower-layer block 51 rather than the connection passage 7 between the middle-layer and lower-layer blocks 51, 52 (see FIG. 2 and FIG. 3).

In the heat exchanger 1 in which the plurality of layers of blocks 5 are stacked on each other in the up and down direction, the water tends to remain in an upper block 5 during draining, particularly, in the second block from the bottom. As in the present preferred embodiment, in the three-layered blocks 51, 52, 53, the water tends to remain in the middle-layer block 52 during draining. Further, during draining, the water in the middle-layer block 52 tends to remain at a position away from the connection passage 7 serving as a drain passage between the middle-layer block 52 and the lower-layer block 51. Therefore, the drain hole 82 provided at any position close to the inlet 71 of the lower-layer block 51 rather than the connection passage 7 makes it possible to drain, through the drain hole 82, the remaining water located away from the connection passage 7 in the middle-layer block 52. This allows, during draining, the water to be drained without remaining in the middle-layer block 52 and thus makes it possible to prevent the water from remaining in the whole of the heat exchanger 1. This in turn makes it possible to prevent the heat exchanger body 10 from being damaged due to expansion of the remaining water when the remaining water has frozen and increase the durability of the plate-type heat exchanger 1.

Specifically, the drain hole 82 is provided through the lower heat exchanger plate 12 of the heat exchanger body 10 located lowermost of the middle-layer block 52 and the upper heat exchanger plate 11 of the heat exchanger body 10 located uppermost of the lower-layer block 51 so as not to overlap a plane where the inlet 71 on the right short side of the lower-layer block 51 is projected (a position directly above the inlet 71 of the lower-layer block 51). For example, the drain hole 82 is provided at a corner located at the rear on the right side (see FIG. 7). This makes it possible to drain, through the drain hole 82 of the heat exchanger body 10 located lowermost of the middle-layer block 52, the water in an area where the water tends to be accumulated (an area indicated by a long dashed circle in FIG. 7) and that is away from the connection passage 7 between the middle-layer block 52 and the lower-layer block 51. Further, when the drain hole 82 is provided on the plane where the inlet 71 of the lower-layer block 51 is projected, the water tends to take a shortcut through the drain hole 82 due to pressure of water flowing upward through the inlet 71 during normal use. Therefore, the drain hole 82 provided at a position shifted from the plane where the inlet 71 of the lower-layer block 51 is projected makes it possible to minimize a flow rate of water taking a shortcut through the drain hole 82. Further, during normal use, the water that takes a shortcut through the drain hole 82 from the lower-layer block 51 into the middle-layer block 52 flows into the upper-layer block 53 located uppermost and is then heated. Therefore, even when the water takes a shortcut through the drain hole 82, the heat exchange performance is hardly degraded.

Note that the drain hole 82 may be further provided between the upper-layer and middle-layer blocks 52, 53 adjacent to each other. In this structure, the drain hole 82 may be provided at any position that does not overlap the plane where the inlet 71 of the middle-layer block 52 is projected (a position directly above the inlet 71 of the middle-layer block 52) and is close to the inlet 71 of the middle-layer block 52 rather than the connection passage 7 between the upper-layer and middle-layer blocks 52, 53. For example, the drain hole 82 may be provided, through the lower heat exchanger plate 12 of the heat exchanger body 10 located lowermost of the upper-layer block 53 and the upper heat exchanger plate 11 of the heat exchanger body 10 located uppermost of the middle-layer block 52, near the middle point between two corners on the left short side corresponding to the inlet 71 of the middle-layer block 52.

Further, the opening area of the second connection passage 8 serving as the bypass hole 81 or the drain hole 82 described above is smaller in diameter than the opening area of the connection passage 7. Accordingly, a flow of water flowing through the connection passage 7 is maintained as the main flow of water flowing between the blocks 5, and it is possible to reduce the flow rate of the water that takes a shortcut through the second connection passage 8 during normal use and thus to suppress degradation in the heat exchange performance. For example, when the connection passage 7 has a diameter of 10 mm, the bypass hole 81 may have a diameter of 3 mm, and the drain hole 82 may have a diameter of 4 mm.

Note that the present invention is not limited to the above-described preferred embodiment, and various modifications can be made within the scope of the claims. For example, the number of layers of blocks to be stacked is not limited to three, and may be two or more. Further, in the heat exchanger 1, both the bypass hole 81 and the drain hole 82 may be provided, but only one of the bypass hole 81 and the drain hole 82 may be provided.

What is claimed is:

1. A heat source apparatus, comprising:

a plate-type heat exchanger, the plate-type heat exchanger comprising:

a plurality of blocks stacked on each other, each of the plurality of blocks including a heat exchanger body configured to exchange heat between a first fluid flowing inside the heat exchanger body and a second fluid flowing outside the heat exchanger body, wherein the heat exchanger body comprises:

an internal space that allows the first fluid to flow in one direction in an extending direction by superimposing two heat exchange plates and joining outer peripheral edges, and a plurality of through holes that penetrate the internal space in a noncommunication state and communicate with the external space to allow the second fluid to flow, each block of the plurality blocks comprises:

exhaust holes formed by the plurality of through holes through which the second fluid flows, an inlet configured to cause the first fluid to flow into the block, and an outlet configured to cause the first fluid to flow out of the block, a first connection passage for the first fluid is formed between blocks adjacent to each other of the plurality of blocks, wherein the first connection passage allowing the outlet of one block of the blocks adjacent to each other and the inlet of another block of the blocks adjacent to each other to communicate with each other, the first connection passage being configured such that first fluid flows from the outlet of the one block toward the inlet of the another block in a first flow direction, the one block being configured such that the first fluid flows from the inlet of the one block toward the outlet of the one block in a second flow direction, the another block being configured such that the first fluid flows from the inlet of the another block toward the outlet of the another block in a third flow direction, the second flow direction and the third flow direction are directions opposite to each other and are substantially orthogonal to the first flow direction, and a second connection passage for the first fluid is provided between at least one pair of blocks adjacent to each other among the plurality of blocks, the second connection passage being configured to cause the first fluid to flow to a position different from the first connection passage, the second fluid is configured to flow in a direction of the arrangement of the plurality of blocks, the second connection passage being configured such that the first fluid flows in a direction in which the plurality of blocks are arranged, and flows in the direction parallel to the flow direction of the second fluid, and the first fluid is water, wherein a small hole is formed on the one block, a small hole is formed on the another block, and the second connection passage is formed by brazing the small hole of the one block to the small hole of the another block.

2. The heat source apparatus of claim 1, wherein the first connection passage for the first fluid is formed between a first block of the plurality of blocks and a second block of the plurality of blocks, wherein the first block is adjacent to the second block, the first fluid flows from an outlet of the first block toward an inlet of the second block in a first direction, and the first block and the second block comprise a first pair of blocks, and the second connection passage for the first fluid is provided between the first pair of blocks, the second connection passage being configured to cause the first fluid to flow in the first direction to a position different from the first connection passage, a third connection passage is formed between a second pair of blocks comprising the second block and a third block of the plurality of blocks, wherein the first fluid flows from an outlet of the second block toward an inlet of the third block in the first direction, and wherein the second block is adjacent to the third block, and a fourth connection passage for the first fluid is provided between the second pair of blocks, the fourth connection passage being configured to cause the first fluid to flow in the first direction to a position different from the third connection passage, wherein the first fluid flows through the first block and the third block in a second direction substantially orthogonal to the first direction, and the first fluid flows through the second block in a third direction substantially orthogonal to the first direction and opposite to the second direction.

3. The heat source apparatus of claim 1, wherein the second connection passage comprises a bypass hole provided at a position where the first fluid is stagnant.

4. The heat source apparatus of claim 2, wherein the fourth connection passage comprises a bypass hole provided at a position where the first fluid is stagnant.

5. The heat source apparatus of claim 1, wherein the second connection passage comprises a drain hole that drains the first fluid from the second block into a first block of the plurality of blocks during a draining operation of the plate-type heat exchanger.

6. The heat source apparatus of claim 5, wherein the one block is a lower block, the another block is an upper block, the small hole is formed on an upper surface of the one block, the small hole is formed on a lower surface of the another block, and the small hole of the one block is larger than the small hole of the another block.

7. The heat source apparatus of claim 6, wherein the small hole of the one block is approximately six millimeters, and the small hole of the another block is approximately four millimeters.

* * * * *